US006149494A

United States Patent [19]

Yang

[11] Patent Number: 6,149,494

[45] Date of Patent: Nov. 21, 2000

[54] TOY WITH A MOVING BODY MOVABLE ON A PLATFORM

[75] Inventor: Chien-Nan Yang, Tainan, Taiwan

[73] Assignee: Dah Yang Toy Industrial Co., Ltd., Tainan, Taiwan

[21] Appl. No.: 09/396,103

[22] Filed: Sep. 14, 1999

[51] Int. Cl.[7] ..... A63H 17/40; A63H 13/00; A63H 29/00; A63F 9/26; A63F 9/00

[52] U.S. Cl. ..... 446/441; 446/458; 446/460; 446/442; 446/443; 446/445; 446/330; 446/351; 446/290; 446/291; 446/292; 273/449; 273/450; 273/454

[58] Field of Search ..... 446/458, 460, 446/441, 442, 443, 330, 351, 290, 291, 292, 280, 288; 273/449, 450, 454

[56] References Cited

U.S. PATENT DOCUMENTS

| | | | |
|---|---|---|---|
| 2,096,333 | 10/1937 | Marx . | |
| 2,121,355 | 6/1938 | Krupp . | |
| 3,548,539 | 12/1970 | Grow . | |
| 3,589,723 | 6/1971 | Glass . | |
| 3,614,106 | 10/1971 | Morrison . | |
| 4,303,240 | 12/1981 | Ellman et al. . | |
| 4,921,458 | 5/1990 | Greenwood . | |
| 5,181,727 | 1/1993 | Fukumura | 273/450 |
| 5,259,806 | 11/1993 | Chang | 446/353 |
| 5,334,078 | 8/1994 | Hippely et al. | 446/470 |
| 5,954,340 | 9/1999 | Tedesco | 273/450 |

*Primary Examiner*—Sam Rimell
*Assistant Examiner*—Kevin Hughes
*Attorney, Agent, or Firm*—Christensen O'Connor Johnson & Kindness, PLLC

[57] ABSTRACT

A toy includes a platform, a moving body, and a balance bar. The moving body has front and rear wheels rotatable about horizontal rotary axes, a turning wheel, and a drive unit coupled to the turning wheel and one of the rear wheels to drive movement of the moving body when the moving body is disposed on the platform. The turning wheel is rotatable about an axis perpendicular to the rotary axes of the front and rear wheels, and prevents the moving body from falling off the platform when the moving body moves to a peripheral edge of the platform. The balance bar has an intermediate fulcrum portion mounted pivotally on the moving body about a horizontal pivot axis, and two arm portions projecting from two opposite lateral sides of the moving body. Each of the arm portions has a distal section provided with a tray plate adapted for placing game tokens thereon such that a moment of force is applied on the balance bar to cause the balance bar to incline about the pivot axis with respect to the moving body according to the weights of the game tokens and the positions of the game tokens on the tray plates.

9 Claims, 7 Drawing Sheets

TOY WITH A MOVING BODY MOVABLE ON A PLATFORM

BACKGROUND OF THE INVENTION

1. Field of the Invention

This invention relates to a toy with a moving body which is movable on a platform and which is provided with a balance bar that can be maintained in a balanced state during movement of the moving body by selectively placing game tokens on two opposite tray plates of the bar.

2. Description of the Related Art

A toy which includes a motor-driven moving body that is movable on a platform and that can be prevented from falling off the platform is well known in the art. However, there is a constant need to develop new toys of the aforesaid type that can entice consumers to purchase the same.

SUMMARY OF THE INVENTION

Therefore, the object of the present invention is to provide a toy which includes a moving body movable on a platform, and a balance bar which is mounted on the moving body and which can be maintained in a balanced state by selectively placing game tokens on two opposite tray plates of the bar during movement of the moving body on the platform.

Accordingly, the toy of the present invention includes a platform, a moving body, and a balance bar. The platform has a top side and a peripheral edge. The moving body has a front end portion provided with a front wheel unit which is rotatable about a horizontal first rotary axis, a rear end portion provided with a horizontal transmission shaft parallel to the first rotary axis, a bottom side provided with a turning wheel between the front and rear end portions, and two opposite lateral sides. The transmission shaft has two opposite ends. The moving body further has a first rear wheel mounted securely on one of the ends of the transmission shaft, and a second rear wheel mounted rotatably on the other one of the ends of the transmission shaft and rotatable about a second rotary axis parallel to the first rotary axis. The turning wheel is rotatable about a horizontal third rotary axis generally perpendicular to the first and second rotary axes. The turning wheel is entirely disposed higher than the lowest vertical point of the front wheel unit and the rear wheels. The moving body is provided with a drive unit that is coupled to the turning wheel and the transmission shaft to drive movement of the moving body on the top side of the platform. The turning wheel contacts the top side of the platform after the front wheel unit extends beyond the peripheral edge, and enables the front wheel unit to roll completely back on top of the platform, thereby preventing the moving body from falling off the platform while the drive unit drives movement of the moving body on the top side of the platform. The balance bar has an intermediate fulcrum portion mounted pivotally on the moving body about a horizontal pivot axis, and two arm portions on opposite sides of the fulcrum portion and projecting from the lateral sides of the moving body. Each of the arm portions has a distal section provided with a tray plate adapted for placing game tokens thereon such that a moment of force is applied on the balance bar to cause the balance bar to incline about the pivot axis with respect to the moving body according to the weights of the game tokens and the positions of the game tokens on the tray plates.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
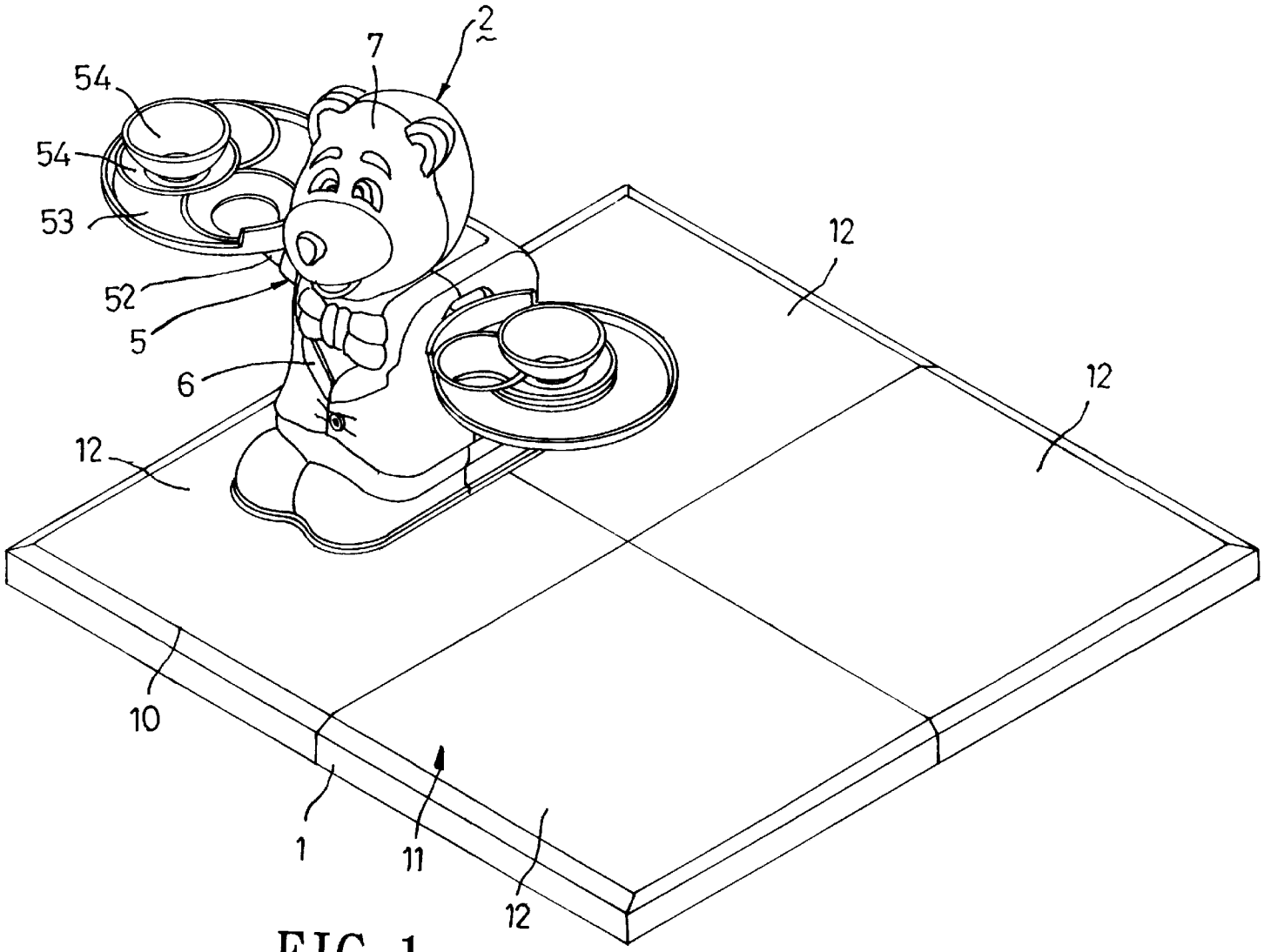
FIG. 1 is a perspective view showing the preferred embodiment a toy of the present invention.
Figure 2:
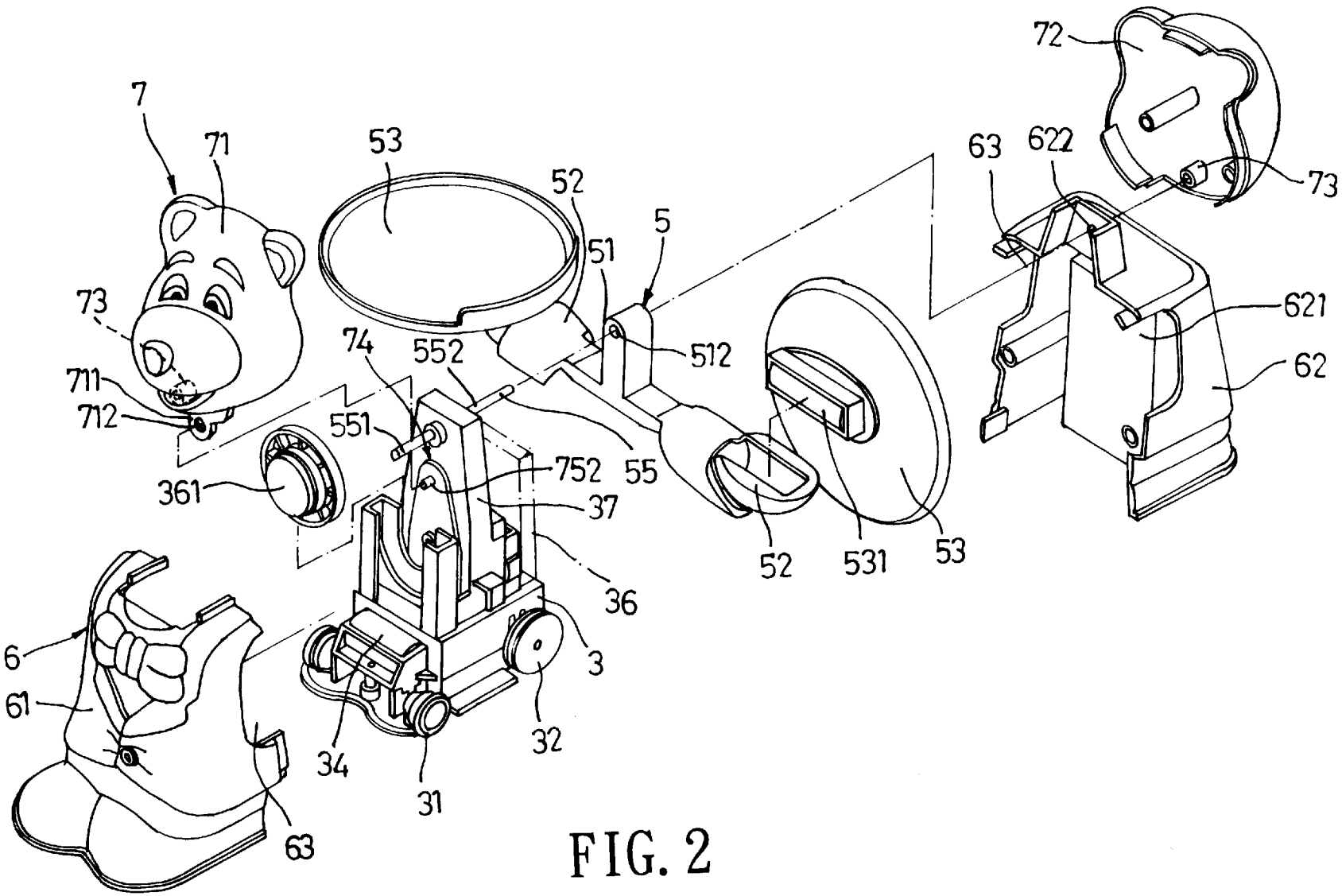
FIG. 2 is an exploded perspective view showing a moving body of the preferred embodiment.

Referring to FIGS. 1 and 2, the preferred embodiment of the toy of the present invention is shown to include a platform 1, a moving body 3 covered by a decorative casing 2, and a balance bar 5 mounted on the moving body 3. The moving body 3 is movable on a top side 11 of the platform 1, and can be prevented from falling off the platform 1 when the moving body 3 moves to a peripheral edge 10 of the platform 1.

Figure 3:
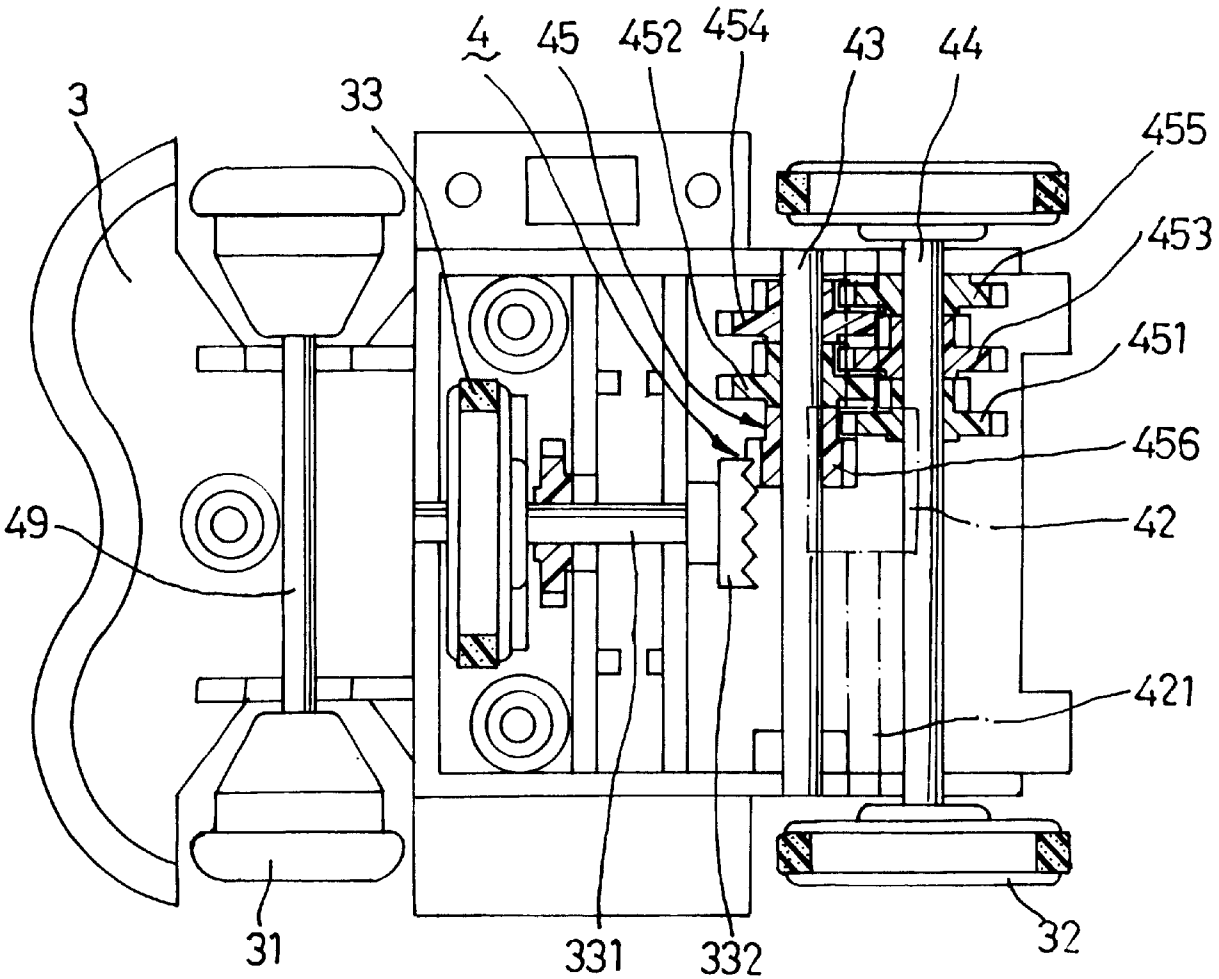
FIG. 3 is a partly sectional bottom view of the moving body of the preferred embodiment, illustrating a drive unit thereof.
Figure 4:
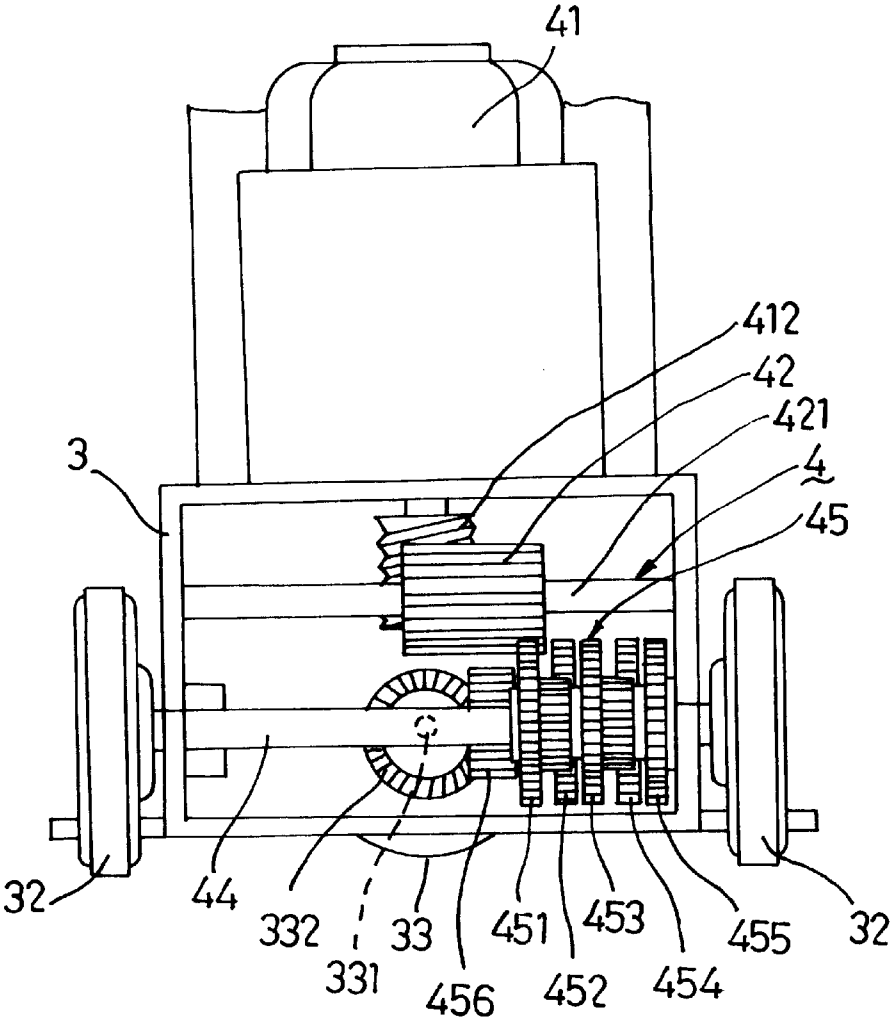
FIG. 4 is a schematic rear side view of the moving body of the preferred embodiment, illustrating the drive unit.

Referring to FIGS. 2 to 4, the moving body 3 has a bottom side provided with a pair of front wheels 31 at a front end portion thereof, a pair of rear wheels 32 at a rear end portion thereof, and a turning wheel 33 between the front and rear wheels 31, 32. The turning wheel 33 has a bottom portion disposed higher than bottom portions of the front and rear wheels 31, 32 such that the turning wheel 33 is normally not in contact with the top side 11 of the platform 1 when the moving body 3 is disposed on the top side 11. The front wheels 31 are mounted securely on two opposite ends of a rotary shaft 49 which is mounted rotatably on the front end portion of the moving body 3 such that the front wheels 31 are rotatable about a horizontal first rotary axis along the rotary shaft 49. Movement of the moving body 3 is driven by a drive unit 4 mounted on the moving body 3. The drive unit 4 includes a motor 41 (see FIG. 5), and a worm shaft 412 driven by the motor 41 to rotate axially. The worm shaft 412 engages a drive gear 42 that is mounted on a horizontal shaft 421 in the moving body 3. The drive gear 42 engages a gear set 45 which includes a plurality of speed-reducing gear members 451 to 455 that are mounted on parallel and horizontal first and second transmission shafts 43, 44. The second transmission shaft 44 is disposed rearwardly of the first transmission shaft 43, and has the rear wheels 32 mounted on two opposite ends thereof. Driving energy provided by the motor 41 is transmitted to the second transmission shaft 44 via the gear set 45 to cause axial rotation of the second transmission shaft 44. A first one of the rear wheels 32 is mounted securely on the second transmission shaft 44. A second one of the rear wheels 32 is mounted rotatably on the second transmission shaft 44. Therefore, the first one of the rear wheels 32 is co-rotatable with the second transmission shaft 44 about a second rotary axis along the second transmission shaft 44. The gear set 45 further includes a gear member 456 which is mounted on the first transmission shaft 43 and which engages a gear member 332 that is secured to one end of a horizontal rotary shaft 331. The rotary shaft 331 has the turning wheel 33 mounted securely thereon. The driving force of the drive unit 4 is thus transmitted to the turning wheel 33 to cause axial rotation of the turning wheel 33 about a horizontal third rotary axis along the rotary shaft 331 which is perpendicular to the rotary shaft 49 and the second transmission shaft 44. When the moving body 3 is normally disposed on the top side 11 of the platform 1, the turning wheel 33 does not contact the top side 11. At this time, the direction of movement of the moving body 3 is not affected by the turning wheel 33. However, when the moving body 3 moves to the peripheral edge 10 such that the front wheels 31 extend beyond the peripheral edge 10, the moving body 3 inclines forwardly and the turning wheel 33 contacts the top side 11 of the platform 1. At this time, since the turning wheel 33 rotates about the third rotary axis which is perpendicular to the first and second rotary axes of the front and rear wheels 31, 32, the turning wheel 33 causes the moving body 3 to turn away from the peripheral edge 10 and enables the front wheels 31 to climb back on the top side 11 of the platform 1. The moving body 3 is thus prevented from falling off the platform 1, and is kept on the top side 11 of the platform 1. The moving body 3 thus performs straight and turning movements on the platform 1. A weight member 34 is provided on a lower portion of the moving body 3 so as to lower the weight center of the moving body 3 and to prevent overturning of the moving body 3 during movement of the moving body 3 on the top side 11 of the platform 1. The moving body 3 is further mounted with a sound generating member 361 and a control circuit 36 for controlling activation of the sound generating member 361 such that a predetermined sound can be generated.

Referring again to FIGS. 1 and 2, the balance bar 5 has an intermediate fulcrum portion 51 and two arm portions 52 on opposite sides of the fulcrum portion 51. The fulcrum portion 51 projects upwardly and transversely relative to the arm portions 52, and has an upper end formed with a pivot hole 512. The arm portions 52 extend from a lower end of the fulcrum portion 51. Each of the arm portions 52 has a distal section provided with a tray plate 53 which is adapted for placing game tokens 54 in the form of small bowls and dishes. The balance bar 5 is mounted on an upright mounting portion 37 of the moving body 3 by means of a horizontal pivot shaft 55 that is mounted securely on the mounting portion 37 and that is perpendicular to the second transmission shaft 44 (see FIG. 3). The pivot shaft 55 has a front section 551 projecting from a front side of the mounting portion 37, and a rear section 552 projecting from a rear side of the mounting portion 37 and extending through the pivot hole 512 in the fulcrum portion 51 of the balance bar 5 to mount the balance bar 5 pivotally on the moving body 3. The arm portions 52 project relative to the lateral sides of the moving body 3. By placing the game tokens 54 on the tray plates 53, a torque, or a moment of force is applied on the balance bar 5 to cause the balance bar 5 to incline about the pivot shaft 55 with respect to the moving body 3 according to the weight of the game tokens 54 and the positions of the game tokens 54 on the tray plates 53.Each of the tray plates 53 has a bottom side provided with a weight member 531 to reduce the effect of each of the game tokens 54 on the weight ratio when the game tokens 54 are added onto the tray plates 53.

The decorative casing 2 includes a body casing 6 with front and rear casing parts 61, 62, and a head casing 7 with front and rear casing parts 71, 72. The front and rear casing parts 61, 62 of the body casing 6 engage one another, and cooperatively cover the moving body 3 from front and rear sides of the moving body 3. The rear casing part 62 is provided with a battery housing 621, which houses a battery set (not shown) for providing electrical energy to the motor 41 of the drive unit 4. The front and rear casing parts 61, 62 of the body casing 6 cooperatively define two openings 63 on lateral sides thereof to permit extension of the arm portions 52 of the balance bar 5 therethrough. The pivot shaft 55 extends through a through hole 622 formed in an upper end portion of the rear casing part 62.

The front and rear casing parts 71, 72 of the head casing 7 engage one another, and are disposed on top of the body casing 6. The front and rear casing parts 71, 72 have main casing portions with confronting inner sides which are formed with axially aligned pivot tubes 73 that are sleeved rotatably and respectively on the front and rear sections 551, 552 of the pivot shaft 55 for mounting the main casing portions of the front and rear casing parts 71, 72 rotatably on the upright mounting portion 37 of the moving body 3. A pivot plate 711 extends downwardly from a lower end of the main casing portion of the front casing part 71, and is formed with a pivot hole 712.

Figure 5:
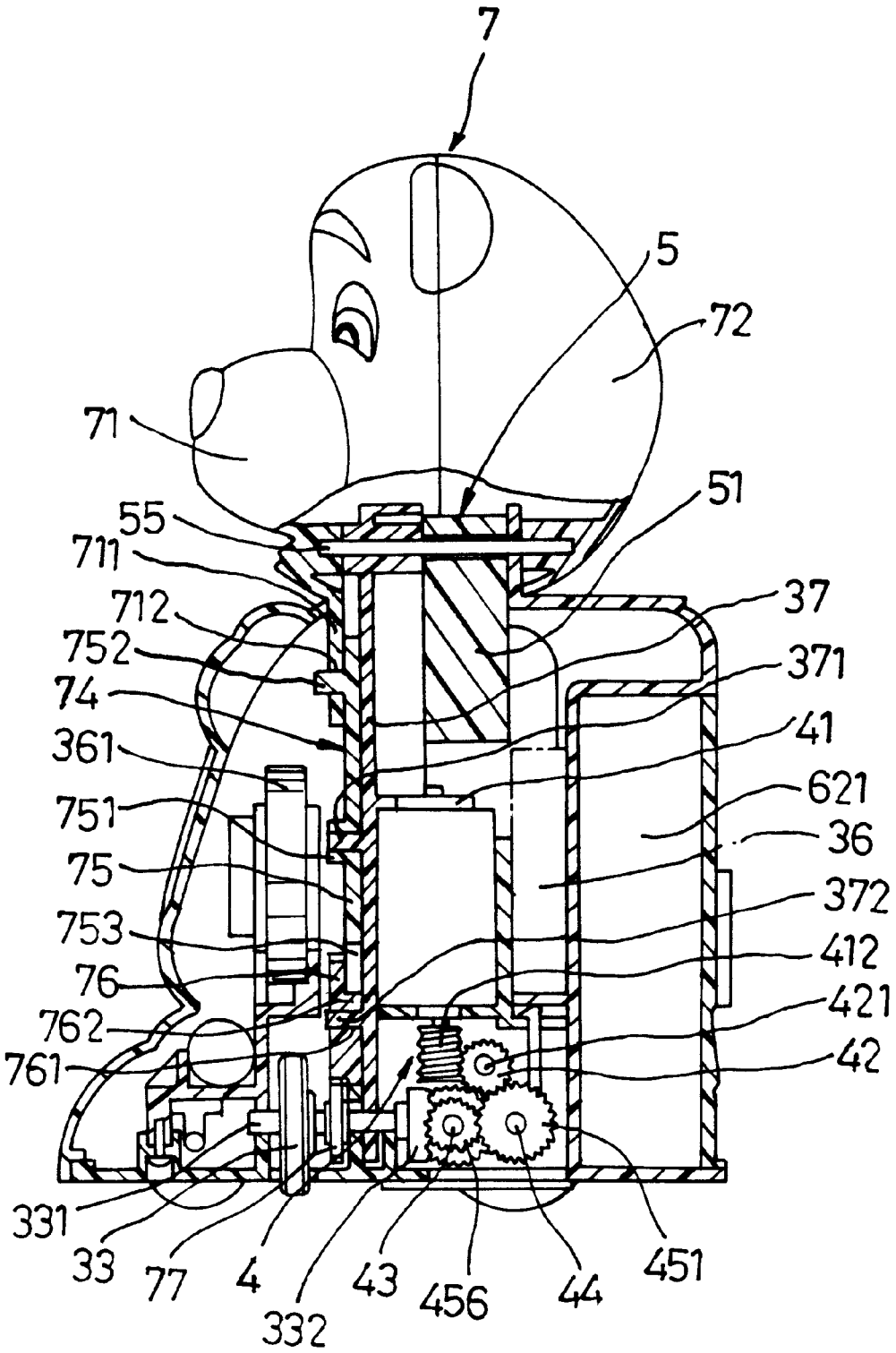
FIG. 5 is a partly sectional view of the moving body of the preferred embodiment.
Figure 6:
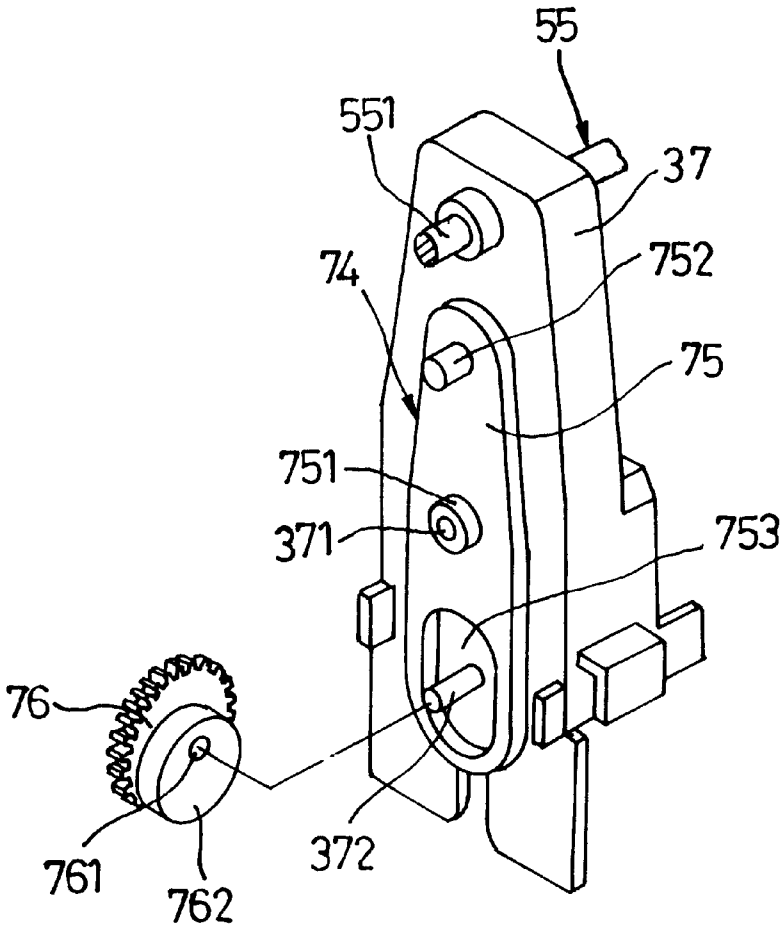
FIG. 6 is an exploded perspective view illustrating a swing unit of the moving body of the preferred embodiment.
Figure 7:
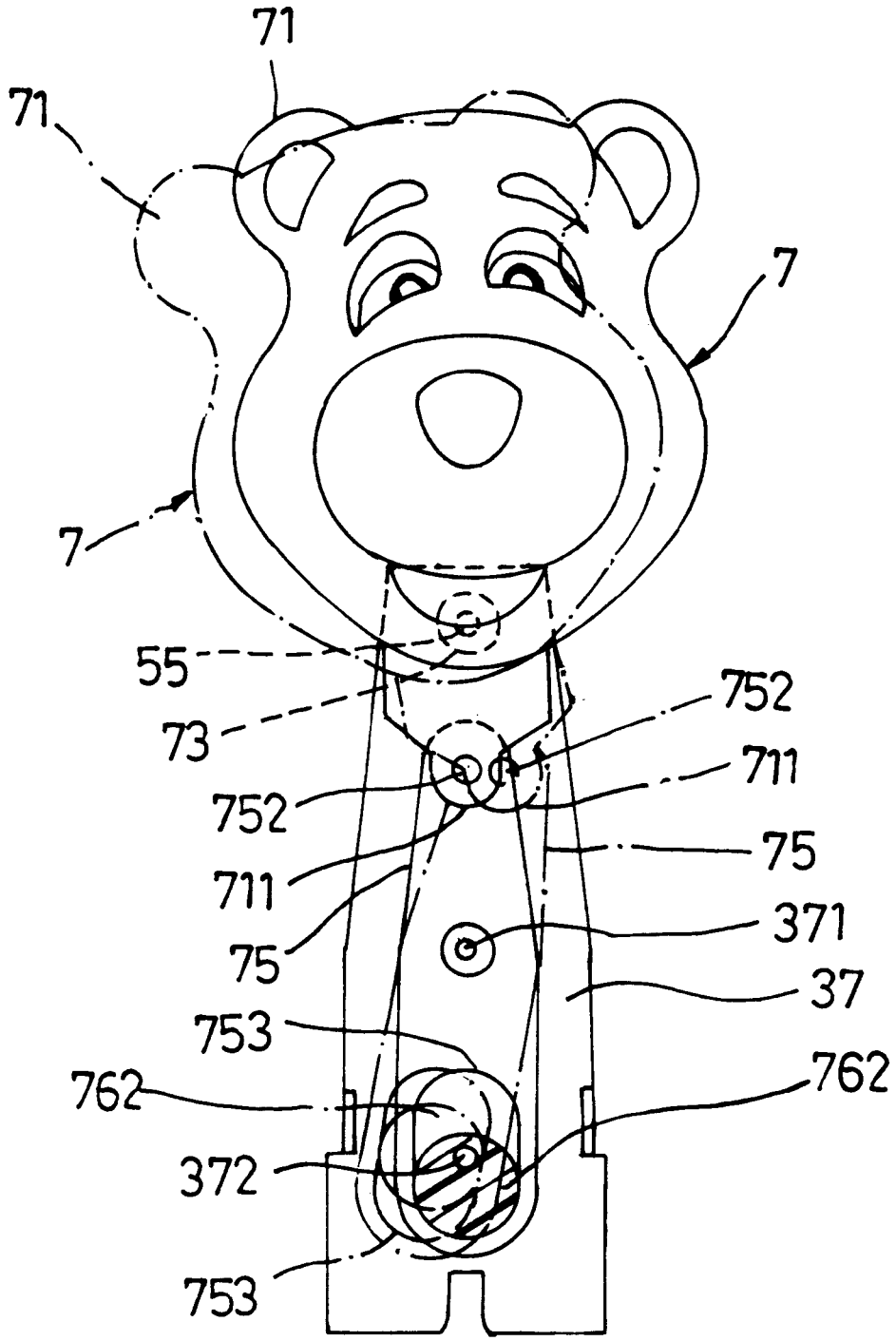
FIG. 7 is a fragmentary schematic view illustrating how the swing unit moves a head casing of the toy of the preferred embodiment.

Referring to FIGS. 2, 5 and 6, a swing unit 74 is mounted on the moving body 3 to cause leftward and rightward swinging of the head casing 7. The swing unit 74 includes an upright and elongated swing plate 75 disposed on the front side of the mounting portion 37 of the moving body 3 and below the front section 551 of the pivot shaft 55. The swing plate 75 has an intermediate portion formed with a pivot tube 751 which is sleeved rotatably on a pivot shaft 371 formed on the front side of the mounting portion 37 and parallel to the pivot shaft 55. The swing plate 75 further has an upper end portion formed with a pivot shaft 752 that projects forwardly and that is parallel to the pivot shafts 55, 371, and a lower end portion formed with an elongated slot 753. The pivot shaft 752 of the swing plate 75 extends rotatably through the pivot hole 712 in the pivot plate 711 of the head casing 7. The mounting portion 37 of the moving body 3 further has an axle 372 which projects forwardly and which extends through the elongated slot 753. The swing unit 74 further includes a gear wheel 76 which has a back side provided with an eccentric cam wheel 762 that extends into the elongated slot 753 in the swing plate 75. The axle 372 extends through an axial hole 761 in the gear wheel 76. Preferably, the width measured between lateral edges of the elongated slot 753 is generally identical to the diameter of the cam wheel 762. The gear wheel 76 engages a gear member 77 which is mounted securely on the rotary shaft 331 of the turning wheel 33 so as to be driven by the drive unit 4 to rotate axially. When the gear wheel 76 rotates axially, the eccentric cam wheel 762 causes the lower end portion of the swing plate 75 to swing leftwardly and rightwardly about the pivot shaft 371, thereby resulting in corresponding rightward and leftward swinging of the upper end portion of the swing plate 75. Simultaneously, the head casing 7 is caused to swing leftwardly and rightwardly about the pivot shaft 55, as shown in FIG. 7.

Referring back to FIGS. 1 to 3, when the moving body 3 is placed on the top side 11 of the platform 1 while the drive unit 4 is actuated, the moving body 3 is driven by the drive unit 4 to move on the top side 11 of the platform 1 without falling off the platform 1. At the same time, the head casing 7 swings leftwardly and rightwardly during movement of the moving body 3. Preferably, the top side 11 of the platform 1 is divided into four differently patterned regions, such as regions 12 printed with different colors. The moving body 3 is designed to pass through the regions 12 in sequence. To play a game with the use of the toy of the present embodiment, the game tokens 54, which are in the form of bowls and dishes, are placed on the tray plates 53 sequentially and respectively by several game players during movement of the moving body 3 on the top side 11 of the platform 1. The game players take turns in placing a selected one of the game tokens 54 on a selected tray plate 53 and at a selected position on the selected tray plate 53 in order to maintain balance of the balance bar 5. To start with, each of the game players is assigned with a selected region 12 on the top side 11 of the platform 1. When the moving body 3 moves to a certain region 12, the game player who was assigned with that region 12 places a selected one of the game token 54 based on the aforesaid considerations such that the balance bar 5 is applied with a torque. The game player who fails to maintain balance of the balance bar 5, i.e., who causes the game tokens 54 to fall off the tray plates 53, loses the game.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A toy comprising:

a platform having a top side and a peripheral edge;

a moving body having a front end portion provided with a front wheel unit which is rotatable about a horizontal first rotary axis, a rear end portion provided with a horizontal transmission shaft parallel to said first rotary axis, a bottom side provided with a turning wheel between said front and rear end portions, and two opposite lateral sides, said transmission shaft having two opposite ends, said moving body further having a first rear wheel mounted securely on one of said ends of said transmission shaft, and a second rear wheel mounted rotatably on the other one of said ends of said transmission shaft and rotatable about a second rotary axis parallel to said first rotary axis, said turning wheel being rotatable about a horizontal third rotary axis generally perpendicular to said first and second rotary axes, said turning wheel being entirely disposed higher than the lowest vertical point of said front wheel unit and said rear wheels, said moving body being provided with a drive unit that is coupled to said turning wheel and said transmission shaft to drive movement of said moving body on said top side of said platform, said turning wheel contacting said top side of said platform after said front wheel unit extends beyond said peripheral edge and enabling said front wheel unit to climb back on top of said platform, thereby preventing said moving body from falling off said platform while said drive unit drives movement of said moving body on said top side of said platform; and a balance bar having an intermediate fulcrum portion mounted pivotally on said moving body about a horizontal first pivot axis, and two arm portions on opposite sides of said fulcrum portion and projecting from said lateral sides of said moving body, each of said arm portions having a distal section provided with a tray plate adapted for placing a plurality of game tokens thereon such that a moment of force is applied on said balance bar to cause said balance bar to incline about said first pivot axis with respect to said moving body according to the weights of the game tokens and the positions of the game tokens on said tray plates.

2. The toy according to claim 1, wherein said first pivot axis is generally perpendicular to said transmission shaft.

3. The toy according to claim 1, wherein said moving body has an upright mounting portion, and is provided with a swing unit which includes:

an elongated swing plate with upper and lower end portions, and an intermediate portion between said upper and lower end portions, said intermediate portion being mounted pivotally on said mounting portion about a second pivot axis parallel to said first pivot axis, said lower end portion being formed with an elongated slot;

a gear wheel coupled to and driven by said drive unit to rotate through a central gear axis; and a cam wheel mounted eccentrically and securely on said gear wheel and extending into said elongated slot in said lower end portion of said swing plate to cause said lower end portion of said swing plate to swing leftward and rightwardly relative to said second pivot axis when said drive unit is operated, thereby resulting in corresponding rightward and leftward swinging movement of said upper end portion of said swing plate.

4. The toy according to claim 3, further comprising a head casing which has a main casing portion mounted pivotally on said mounting portion of said moving body about a third pivot axis parallel to and disposed above said second pivot axes, and a pivot plate that extends downwardly from said main casing portion and that is mounted pivotally on said upper end portion of said swing plate about a fourth pivot axis parallel to said third pivot axis.

5. The toy according to claim 1, wherein said fulcrum portion of said balance bar projects upwardly and transversely relative to said arm portions, and has an upper end formed with a pivot hole, and a lower end connected to said arm portions, said moving body having an upright mounting portion and a pivot shaft which is mounted securely on said mounting portion and which extends along said first pivot axis, said pivot shaft extending through said pivot hole for mounting said fulcrum portion of said balance bar pivotally on said moving body.

6. The toy according to claim 1, wherein each of said tray plates has a bottom side with a weight member mounted thereon.

7. The toy according to claim 1, further comprising a body casing which includes front and rear casing parts that engage one another and that cover cooperatively said moving body, said body casing having two lateral openings to permit said arm portions of said balance bar to extend therethrough.

8. The toy according to claim 1, wherein said top side of said platform is divided into a plurality of differently patterned regions.

9. The toy according to claim 8, wherein said regions are printed with different colors, respectively.

* * * * *